US009159523B2

(12) United States Patent
Subraya

(10) Patent No.: US 9,159,523 B2
(45) Date of Patent: Oct. 13, 2015

(54) TUNGSTEN OXIDE COATED X-RAY TUBE FRAME AND ANODE ASSEMBLY

(75) Inventor: Madhusudhana T. Subraya, New Berlin, WI (US)

(73) Assignee: General Electric Company, Schenectady, NY (US)

( * ) Notice: Subject to any disclaimer, the term of this patent is extended or adjusted under 35 U.S.C. 154(b) by 644 days.

(21) Appl. No.: 13/437,496

(22) Filed: Apr. 2, 2012

(65) Prior Publication Data

US 2012/0189104 A1 Jul. 26, 2012

Related U.S. Application Data

(63) Continuation-in-part of application No. 11/846,036, filed on Aug. 28, 2007, now abandoned.

(51) Int. Cl.

| | |
|---|---|
| ***H01J 35/10*** | (2006.01) |
| ***H01J 35/16*** | (2006.01) |
| ***H05G 1/02*** | (2006.01) |
| *H01J 35/08* | (2006.01) |
| *H01J 35/12* | (2006.01) |

(52) U.S. Cl.

CPC ..... *H01J 35/105* (2013.01); *H01J 35/108* (2013.01); *H01J 35/16* (2013.01); *H01J 35/08* (2013.01); *H01J 35/10* (2013.01); *H01J 35/12* (2013.01); *H01J 2235/1204* (2013.01); *H01J 2235/1216* (2013.01); *H01J 2235/1229* (2013.01); *H01J 2235/1233* (2013.01); *H05G 1/025* (2013.01)

(58) Field of Classification Search

CPC ..... H01J 35/105; H01J 35/12; H01J 35/16; H01G 1/025; H01G 1/02

USPC ..... 378/119, 121, 125, 127–129, 141–144

See application file for complete search history.

(56) References Cited

U.S. PATENT DOCUMENTS

| | | | |
|---|---|---|---|
| 3,649,355 | A | 3/1972 | Hennig |
| 3,819,971 | A | 6/1974 | Kaplan et al. |
| 3,855,492 | A | 12/1974 | Langer et al. |
| 4,271,372 | A | 6/1981 | Geldner et al. |
| 4,276,493 | A | 6/1981 | Srinivasa et al. |
| 4,320,323 | A | 3/1982 | Magendans et al. |
| 4,520,496 | A | 5/1985 | Schreiber et al. |
| 4,534,993 | A | 8/1985 | Magendans et al. |
| 4,953,190 | A | 8/1990 | Kukoleck et al. |
| 5,150,397 | A | 9/1992 | Randzaao |
| 5,159,619 | A | 10/1992 | Benz et al. |
| 5,652,778 | A | 7/1997 | Tekriwal |
| 5,995,584 | A | 11/1999 | Bhatt |
| 6,132,812 | A | 10/2000 | Rodhammer et al. |
| 6,212,753 | B1 | 4/2001 | Derakhshan et al. |
| 6,390,875 | B1 | 5/2002 | Warren et al. |
| 6,554,179 | B2 | 4/2003 | Horner et al. |
| 7,079,624 | B1 | 7/2006 | Miller et al. |
| 2004/0234041 | A1 | 11/2004 | Artig et al. |
| 2006/0146985 | A1 | 7/2006 | Deutscher et al. |
| 2008/0181366 | A1 | 7/2008 | Bamola et al. |
| 2010/0040202 | A1 * | 2/2010 | Lee ..... 378/143 |

* cited by examiner

*Primary Examiner* — Anastasia Midkiff

(74) *Attorney, Agent, or Firm* — Ziolkowski Patent Solutions Group, SC

(57) ABSTRACT

An x-ray tube having a coated x-ray tube frame inner surface and a coated anode assembly is provided. The x-ray tube includes an x-ray tube frame in which an anode assembly is disposed therein. A cathode assembly is also disposed within the x-ray tube frame that emits an electron beam to strike a target surface of the anode assembly and form x-rays. A plasma-sprayed tungsten oxide coating is formed on an inner surface of the x-ray tube frame and on the anode assembly to dissipate heat created by the electron beam.

19 Claims, 3 Drawing Sheets

TUNGSTEN OXIDE COATED X-RAY TUBE FRAME AND ANODE ASSEMBLY

CROSS-REFERENCE TO RELATED APPLICATION

The present application is a continuation-in-part of and claims priority to U.S. patent application Ser. No. 11/846,036 filed Aug. 28, 2007, the disclosure of which is incorporated herein.

BACKGROUND OF THE INVENTION

The present invention relates generally to x-ray imaging systems. More particularly, the present invention relates to systems and methods of improving heat transfer and lowering peak temperatures within an x-ray imaging tube.

Traditional x-ray imaging systems include an x-ray source and a detector array. X-rays are generated by the x-ray source, pass through an object, and are detected by the detector array. Electrical signals generated by the detector array are conditioned to reconstruct an x-ray image of the object.

In general, an x-ray generating device is formed with a vacuum housing that encloses an anode assembly and a cathode assembly. The cathode assembly includes an electron emitting filament that is capable of emitting electrons. The anode assembly provides an anode target that is spaced apart from the cathode and oriented so as to receive electrons emitted by the cathode. In operation, electrons emitted by the cathode filament are accelerated towards a focal spot on the anode target by placing a high voltage potential between the cathode and the anode target. These accelerating electrons impinge on the focal spot area of the anode target. The anode target is constructed of a high refractory metal so that when the electrons strike, at least a portion of the resultant kinetic energy generates x-radiation, or x-rays. The x-rays then pass through a window that is formed within a wall of the vacuum enclosure, and are collimated towards a target area, such as a patient. As is well known, the x-rays that pass through the target area can be detected and analyzed so as to be used in any one of a number of applications, such as a medical diagnostic examination.

In general, only a very small portion—approximately one percent in some cases—of an x-ray tube's input energy results in the production of x-rays. In fact, the majority of the input energy resulting from the high speed electron collisions at the target surface is converted into heat of extremely high temperatures. This excess heat is absorbed by the anode assembly and is conducted to other portions of the anode assembly and to the other components that are disposed within the vacuum housing. Over time, this heat can damage the anode, the anode assembly, and/or other tube components, and can reduce the operating life of the x-ray tube and/or the performance and operating efficiency of the tube.

Several approaches have been used to help alleviate problems arising from the presence of the high operating temperatures in the x-ray tube. For example, in some x-ray devices the x-ray target, or focal track, is positioned on an annular portion of a rotatable anode disk. The anode disk (also referred to as the rotary target or the rotary anode) is then mounted on a supporting shaft and rotor assembly that can then be rotated by some type of motor. During operation of the x-ray tube, the anode disk is rotated at high speeds, which causes a focal spot on the focal track to continuously rotate into and out of the path of the electron beam. In this way, the electron beam is in contact with any given focal spot along the focal track for only short periods of time. This allows the remaining portion of the track to cool during the time that it takes to rotate back into the path of the electron beam, thereby reducing the amount of heat absorbed by the anode.

While the rotating nature of the anode reduces the amount of heat present at the focal spot on the focal track, a large amount of heat is still present within the anode, the anode drive assembly, and other components within the evacuated housing. This heat must be continuously removed to prevent damage to the tube (and any other adjacent electrical components) and to increase the x-ray tube's efficiency and overall service life.

Prior art x-ray generating devices have taken different approaches to removing this heat from the x-ray tube. In one approach, prior art x-ray generating devices rely upon the use of a second outer housing, separate from the housing forming the vacuum enclosure, to provide a variety of functions, including cooling of the x-ray tube with a coolant, and preventing excessive radiation emissions. This outer housing adds cost and complexity to the x-ray generating device, and can reduce its long term reliability.

In another approach, a single integral housing design is implemented and designed to cool the x-ray tube while also providing radiation shielding. Such a design relies on radiative heat transfer from the anode target to the housing. Various processes, such as sandblasting, grinding, and greening can be used to increase the emissivity of the frame for improved heat transfer, with sandblasting and grinding providing for an emissivity of about 0.35 for radiation having a wavelength of approximately 1.5 micrometers and greening providing for an emissivity of about 0.73 for radiation having a wavelength of approximately 1.5 micrometers. While such emissivity values may be adequate and provide enough cooling to operate the x-ray tube, such values do not provide for optimal performance of the x-ray tube. That is, performance of the x-ray tube could be improved by further increasing the emissivity value of components in the x-ray tube. The improved heat transfer would serve to decrease the maximum temperature imposed on critical components in the x-ray tube, thus leading to increased tube life and increased throughput/performance of the tube.

Another consideration for designs incorporating a single integral housing is that they provide adequate radiation shielding. In particular, such designs require the use of a layer of x-ray shielding material, such as lead, on the housing walls to prevent unwanted radiation emissions. This adds cost and manufacturing complexity to the device, increases its overall size, and may not be desirable from an environmental and safety standpoint.

Therefore, a need exists for an x-ray tube design that can provide improved cooling of the anode assembly and other components within the vacuum enclosure to provide for optimal performance of the x-ray tube. It would also be desirable for the x-ray tube to provide sufficient levels of radiation containment without using lead shields and the like.

BRIEF DESCRIPTION OF THE INVENTION

The present invention overcomes the aforementioned problems by providing a method and apparatus for providing an x-ray tube having a coated x-ray tube frame inner surface and a coated anode assembly. The coating applied to the x-ray tube frame inner surface and anode assembly improves the emissivity of those surfaces, which improves the radiative heat transfer from a high temperature source (i.e., anode assembly) to a low temperature sink (i.e., x-ray tube frame).

In accordance with one aspect of the present invention, an x-ray tube includes an x-ray tube frame, an anode assembly disposed within the x-ray tube frame, a cathode assembly disposed within the x-ray tube frame that emits an electron beam to strike a target surface of the anode assembly and form x-rays, and a plasma-sprayed tungsten oxide coating formed on an inner surface of the x-ray tube frame and on the anode assembly to dissipate heat created by the electron beam.

In accordance with another aspect of the present invention, a method of manufacturing an x-ray tube assembly includes the steps of forming a vacuum enclosure, the vacuum enclosure having a high vacuum in an interior volume thereof and positioning a cathode assembly within the interior volume of the vacuum enclosure. The method also includes the steps of positioning a target assembly within the interior volume of the vacuum enclosure and plasma spraying a tungsten oxide coating to an interior face of the vacuum enclosure and to the target assembly.

In accordance with a further aspect of the present invention, an x-ray source includes a housing comprising an interior surface that surrounds a vacuum chamber and an anode assembly positioned within the housing and comprising a focal track, the anode assembly connected to the housing by way of a bearing assembly. The x-ray source also includes a cathode positioned across from the anode assembly within the vacuum chamber and configured to shoot a stream of electrons toward the focal track, wherein thermal radiation having a wavelength range of approximately 0.3 to 1.5 micrometers is formed when the electron stream strikes the focal track. The x-ray source further includes a coating applied to the interior surface of the housing and to the anode assembly, the coating having a spectral emittance of above approximately 0.9 for the thermal radiation and being substantially non-transmissive to x-ray radiation.

Various other features and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
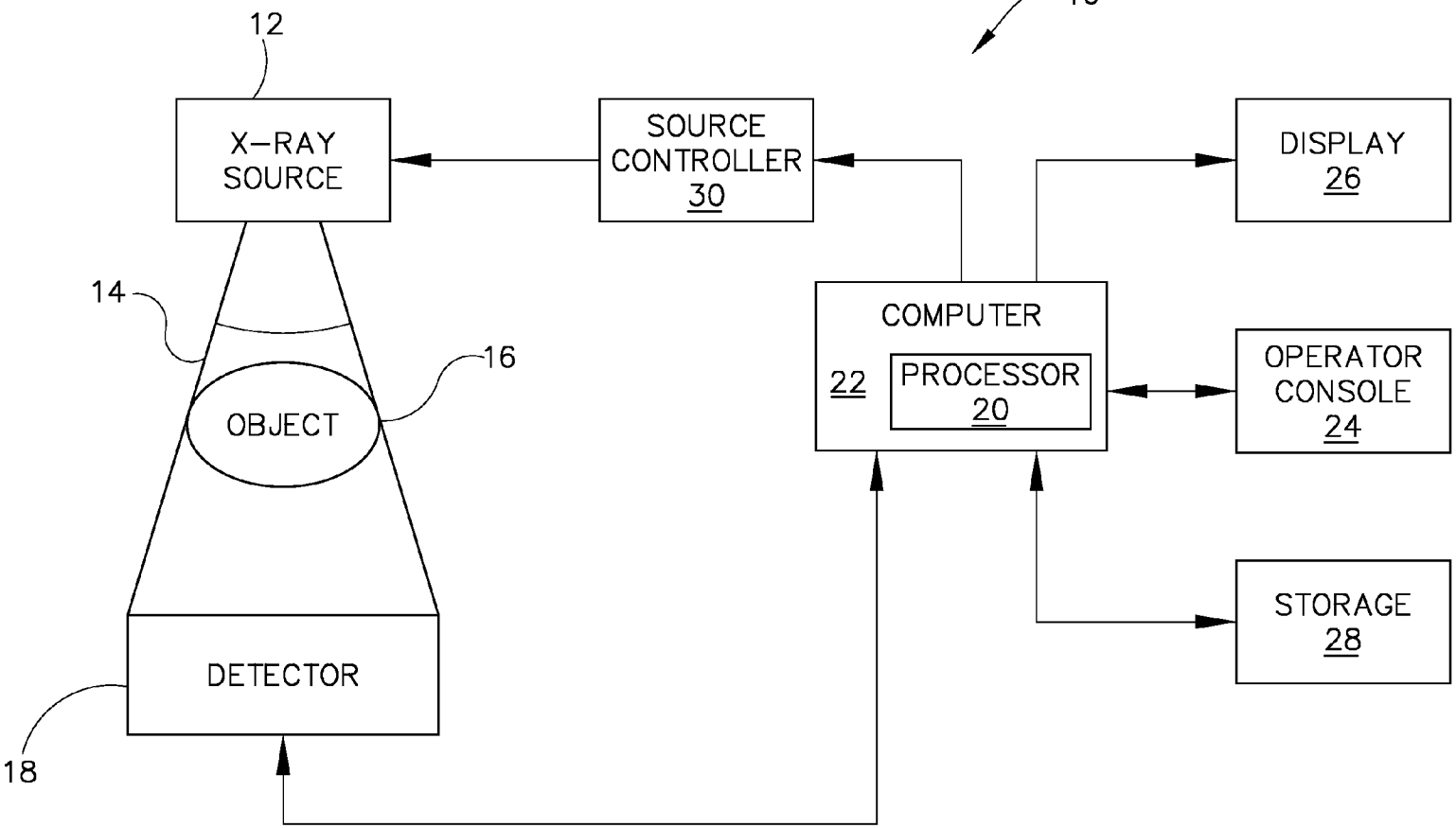
FIG. 1 is a block schematic diagram of an x-ray imaging system according to the present invention.

FIG. 1 is a block diagram of an embodiment of an imaging system 10 designed both to acquire original image data and to process the image data for display and/or analysis in accordance with the present invention. It will be appreciated by those skilled in the art that the present invention is applicable to numerous medical imaging systems implementing an x-ray tube, such as x-ray or mammography systems. Other imaging systems such as computed tomography systems and digital radiography systems, which acquire image three dimensional data for a volume, also benefit from the present invention. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays pass through object 14 and, after being attenuated by the object, impinge upon a detector array 18. Each detector in detector array 18 produces an analog electrical signal that represents the intensity of an impinging x-ray beam, and hence the attenuated beam, as it passes through the object 16. In one embodiment, detector array 18 is a scintillation based detector, however, it is also envisioned that direct-conversion type detectors (e.g., CZT detectors, etc.) may also be implemented.

A processor 20 receives the analog electrical signals from the detector array 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, floppy discs, compact discs, etc. The operator may also use console 24 to provide commands and instructions to computer 22 for controlling a source controller 30 that provides power and timing signals to x-ray source 12.

Figure 2:
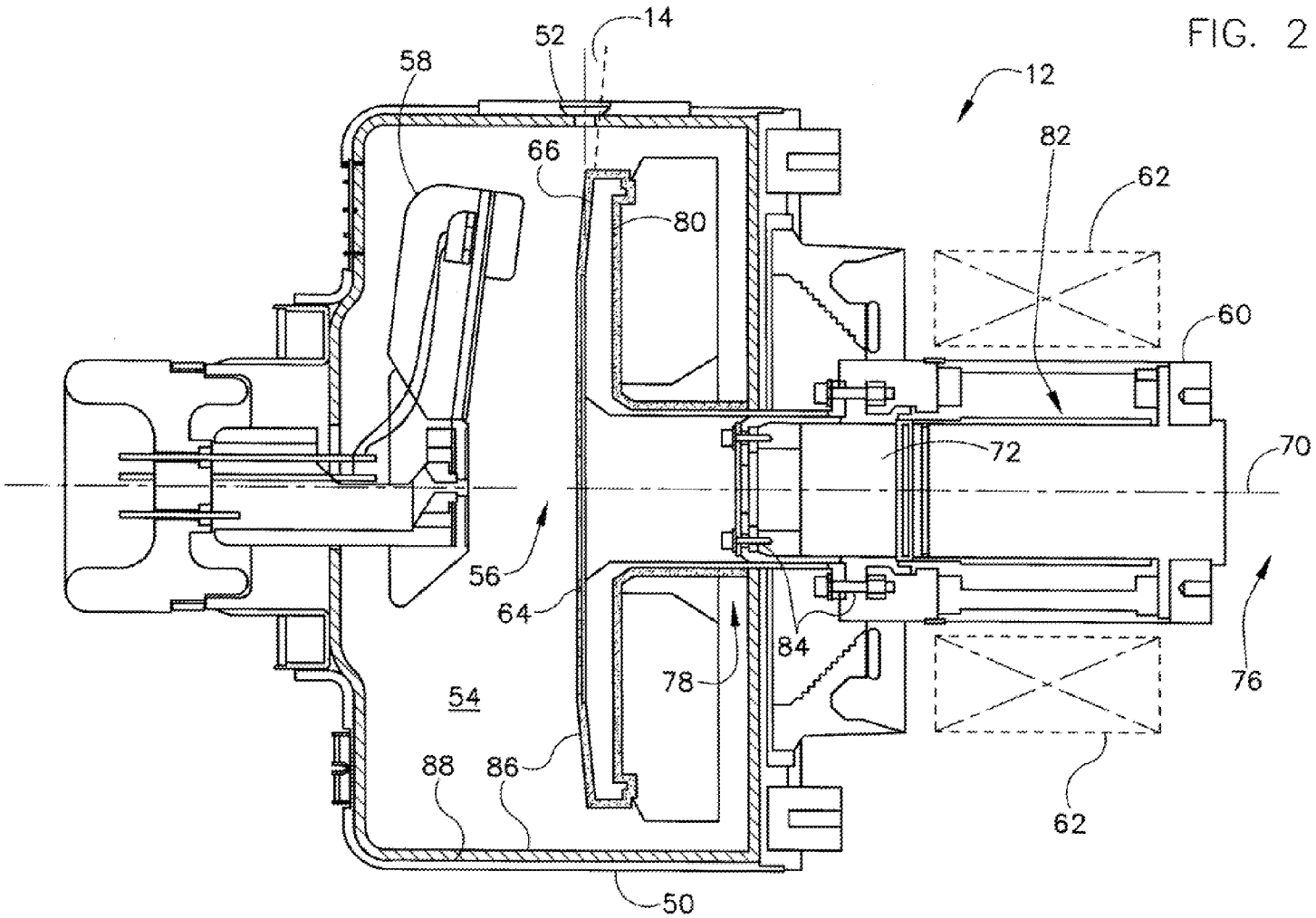
FIG. 2 is a cross-sectional view of an x-ray tube useable with the system illustrated in FIG. 1.

FIG. 2 illustrates a cross-sectional view of x-ray source 12 in the form of an x-ray tube that is useable with the CT imaging system 10. The x-ray tube 12 includes a frame 50 (i.e., housing) having a radiation emission passage 52 formed therein. The frame 50 encloses a vacuum 54, which houses an anode 56 assembly (i.e., target assembly), a cathode assembly 58, and a rotor 60. A stator 62 drives rotor 60, which rotationally drives anode assembly 56.

The material used to form frame 50 is substantially non-porous so as to provide vacuum integrity and has sufficient thermal capacity so as to permit frame 50 to function as a thermal reservoir of heat dissipated by anode assembly 56 and conduct heat away from anode assembly 56. In one embodiment, anode assembly 56 can, at least in part, be formed of a substrate having a tungsten rhenium alloy therein. More specifically, rotating anode assembly 56 can be made of molybdenum, with a 1-2 mm thick surface layer of an alloy of tungsten and rhenium (5-15%) applied thereon. Molybdenum can be used as the anode base because it has twice the heat capacity of pure tungsten and exhibits excellent radiation shielding properties. The rhenium provides for greater elasticity in the alloy, which prevents cracking of the surface and extends the life of the X-ray tube.

Referring still to FIG. 2, cathode assembly 58 generates and emits electrons across vacuum 54 in the form of an electron beam, which is directed at a target cap 64 on anode assembly 56. More specifically, the electron beam strikes target cap 64 along a focal track 66 on anode assembly 56. To avoid overheating on the focal track 66 from the electrons, target cap 64 is rotated at a high rate of speed about a centerline 70 at, for example, 90-250 Hz. The x-rays 16 are produced when the electrons are suddenly decelerated as they are directed from the cathode assembly 58 to the anode assembly 56 via a potential difference therebetween of, for example, sixty-thousand volts or more in the case of CT applications. The x-rays 16 are emitted through the radiation emission passage 52 toward a detector array, such as detector array 18 of FIG. 2.

Anode assembly 56 also includes a bearing assembly 72 by which anode assembly 56 is secured to (and rotated relative to) frame 50. A center shaft 74 is rotatably positioned in bearing assembly 72 and attached to the rotor 60 at a first end 76 and attached to the target cap 64 at a second end 78. The center shaft 74 is affixed to target cap 64 by way of a braze joint 80 to provide for a secure connection therebetween. Bearing assembly 72 is attached to center shaft 74 and is mounted in a stem 82 which is supported by frame 50 and connected thereto by way of bolted joints 84.

As the electron beam strikes target cap 64, heat is generated. The high speed electron collisions at the focal track 66 create extremely high temperatures in the anode assembly 56 and in x-ray tube 14. To transfer out the heat absorbed by the target cap 64, a coating 86 is applied to the anode assembly 56 and x-ray tube frame 50. More specifically, coating 86 is applied to an interior surface 88 of x-ray tube frame 50 and thus is in direct contact with the interior volume that forms vacuum chamber 54. Coating 86 conducts heat to other portions of the anode assembly 56 and to the other components that are disposed within the frame 50.

Figure 3:
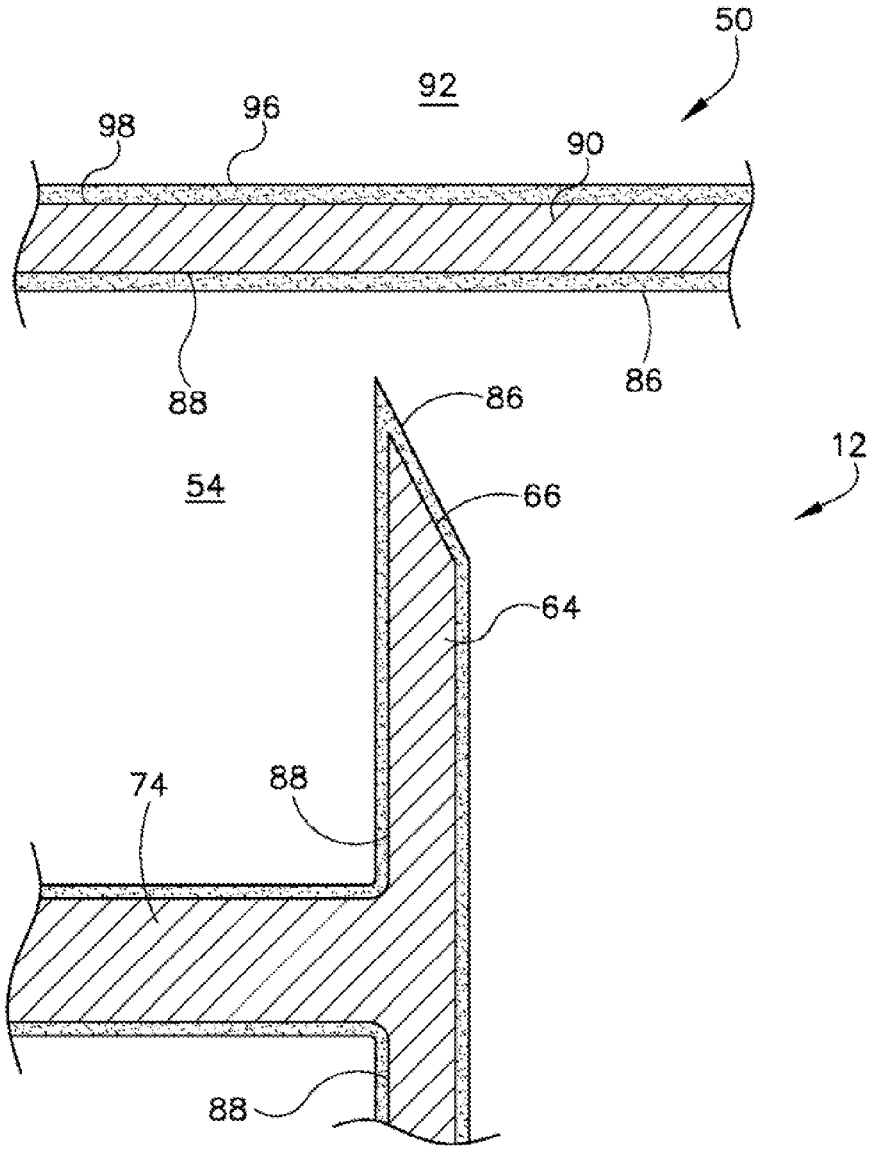
FIG. 3 is a cross-sectional view of a portion of the x-ray tube illustrated in FIG. 2.

Referring now to FIG. 3, in a preferred embodiment, coating 86 is comprised of tungsten or a tungsten based composite/alloy (e.g., tungsten and iron, Densimet®). As set forth above, x-ray tube frame 50 and/or anode assembly 56 can be formed of a substrate 90 that contains a tungsten rhenium alloy on a surface thereof, and as such, the tungsten based coating 86 has a coefficient of thermal expansion similar to the substrate material 90. The tungsten coating 86 can be in the form of a metal powder that is applied to interior surface 88 of x-ray tube frame 50 and to the anode assembly 56 by a plasma spraying process. The plasma-sprayed tungsten coating 86 provides a surface having an improved spectral emittance (i.e., emissivity) that increases radiative heat transfer from the anode assembly 56 to x-ray tube frame 50 and from x-ray tube frame 50 out to an ambient environment 92. The x-ray tube frame 50 and anode assembly 56, upon application of the plasma-sprayed tungsten coating 86, presents a surface having an emissivity at or above 0.9. More specifically, for the thermal radiation having a wavelength of less than approximately 1 micrometer that is generated by the electron beam striking the target cap 64, the emissivity of the plasma-sprayed tungsten coating 86 is 0.9. In one embodiment, the coating 86 has a thickness of approximately 100 micrometers; however, it is envisioned that coating 86 could have a thickness of a greater or lesser amount. That is, the amount of tungsten present in a coating of a tungsten based alloy will determine the amount that will need to be applied. The amount used will thus dictate the thickness of the coating 86 required.

The application of coating 86 to anode assembly 56 provides for improved heat transfer from anode assembly 56 to x-ray tube frame 50. Consequently, the maximum temperature of components in anode assembly 56, such as focal track 66, braze joint 80, bolted joint 84, and bearing assembly 72 (shown in FIG. 2), can be effectively reduced. As such, the life of these components can be increased and pre-mature failure and/or performance issues of anode assembly 56 can be prevented. As an example, Table 1 displays the expected maximum temperature for several components in anode assembly 56 for an 8 kW steady state load applied to x-ray tube 12. Maximum temperatures for the components are predicted where plasma-sprayed tungsten coating 86 is applied to inner surface 88 of x-ray tube frame 50 and anode assembly 56 as compared to if anode assembly 56 was blasted/grounded and x-ray tube frame 50 was finished with a greening process.

TABLE 1

| X-ray Tube Component | Maximum Temperature (° C.) w/Plasma-Sprayed Tungsten Coating X-ray Tube Frame: $\epsilon = 0.9$ Anode Assembly: $\epsilon = 0.9$ | Maximum Temperature (° C.) w/Blasted/ Ground Anode Assembly & Greened X-Ray Tube Frame X-ray Tube Frame: $\epsilon = 0.35$ Anode Assembly: $\epsilon = 0.75$ |
|---|---|---|
| Focal Track | 876 | 1008 |
| Braze Joint | 835 | 963 |
| Bolted Joint | 628 | 656 |
| Bearing Assembly | 535 | 562 |

In addition to providing improved emissivity, the plasma-sprayed tungsten coating 86 also provides x-ray shielding properties. The substrate 90 comprising x-ray tube frame 50, together with coating 86, provides a sufficient level of radiation shielding, and does so with a significantly reduced frame wall thickness. While plasma-sprayed tungsten coating 86 on inner surface 88 provides sufficient x-ray shielding, it is also envisioned that an additional outer coating 96 could be applied to an outer surface 98 of x-ray tube frame 50 to further provide x-ray radiation blocking. The outer coating 96 could also be a plasma sprayed tungsten coating or another suitable radiation absorbing material.

While application of a plasma-sprayed tungsten coating to x-ray tube frame 50 and anode assembly 56 has been described above, it is envisioned that other coatings may also be applied that have an emissivity of approximately 0.9 in the wavelength range of 0.3 to 1.5 micrometers that is typically encountered in an x-ray tube environment. The use of different metal powder mixtures may be dictated by the particular type of substrate material being used. For example, for the tungsten alloy coating mentioned above, other components could be used in place of the iron, such as copper, nickel, cobalt, aluminum, and others. Again, specific choices may depend upon the particular design objectives. That is, one metal may be chosen depending upon the type of substrate being used so as to achieve a proper thermal expansion rate match. Also, the metal should be capable of being alloyed with the other constituent of the powder metal mixture.

According to an exemplary embodiment of the invention, the coating 86 is in the form of a tungsten oxide coating applied to x-ray tube frame 50 and anode assembly 56. Beneficially, the tungsten oxide coating provides even greater emissivity than the tungsten/tungsten alloys set forth above, enabling a further increase in radiative heat transfer from the anode assembly 56 to x-ray tube frame 50 and from x-ray tube frame 50 out to an ambient environment 92. For example, the x-ray tube frame 50 and anode assembly 56, upon application of the plasma-sprayed tungsten oxide coating 86, presents a surface having an emissivity above 0.9 (e.g., ~approximately 1.0) for thermal radiation having a wavelength of less than approximately 1 micrometer that is generated by the electron beam striking the target cap 64, as compared to an emissivity of 0.9 or less for a plasma-sprayed pure tungsten or Densimet® coating.

It is recognized that the tungsten oxide coating 86 applied to the interior of x-ray tube frame 50 and anode assembly 56 does not exhibit ideal x-ray shielding properties for x-ray tube 12 as compared to a pure tungsten or other tungsten alloy coating. That is, it is known that the density of tungsten oxide (~7.16 g/cm$^3$) is much less than the density of pure tungsten (~19.25 g/cm$^3$) or Densimet® (17.00 to 18.8 g/cm$^3$), for example. However, according to embodiments of the invention, it is recognized that the main function of coating 86 is not to provide x-ray shielding, but to provide improved emissivity in x-ray tube 12 and an accompanying improvement of radiative heat transfer from the anode assembly 56 to x-ray tube frame 50 and from x-ray tube frame 50 out to an ambient environment 92. In one embodiment of the invention, it is recognized that a material that exhibits more ideal x-ray radiation blocking properties could be selected for outer coating 96 (e.g., pure tungsten or Densimet®, or another suitable radiation absorbing material) that is applied to the exterior of x-ray tube 12, while the tungsten oxide coating 86 is applied to the interior of x-ray tube frame 50 and to the anode assembly 56 to maximize the emissivity values within the x-ray tube 12.

Therefore, according to one embodiment of the present invention, an x-ray tube includes an x-ray tube frame, an anode assembly disposed within the x-ray tube frame, a cathode assembly disposed within the x-ray tube frame that emits an electron beam to strike a target surface of the anode assembly and form x-rays, and a plasma-sprayed tungsten oxide coating formed on an inner surface of the x-ray tube frame and on the anode assembly to dissipate heat created by the electron beam.

According to another embodiment of the present invention, a method of manufacturing an x-ray tube assembly includes the steps of forming a vacuum enclosure, the vacuum enclosure having a high vacuum in an interior volume thereof and positioning a cathode assembly within the interior volume of the vacuum enclosure. The method also includes the steps of positioning a target assembly within the interior volume of the vacuum enclosure and plasma spraying a tungsten oxide coating to an interior face of the vacuum enclosure and to the target assembly.

According to yet another embodiment of the present invention, an x-ray source includes a housing comprising an interior surface that surrounds a vacuum chamber and an anode assembly positioned within the housing and comprising a focal track, the anode assembly connected to the housing by way of a bearing assembly. The x-ray source also includes a cathode positioned across from the anode assembly within the vacuum chamber and configured to shoot a stream of electrons toward the focal track, wherein thermal radiation having a wavelength range of approximately 0.3 to 1.5 micrometers is formed when the electron stream strikes the focal track. The x-ray source further includes a coating applied to the interior surface of the housing and to the anode assembly, the coating having a spectral emittance of above approximately 0.9 for the thermal radiation and being substantially non-transmissive to x-ray radiation.

The present invention has been described in terms of the preferred embodiment, and it is recognized that equivalents, alternatives, and modifications, aside from those expressly stated, are possible and within the scope of the appending claims.

What is claimed is:

1. An x-ray tube comprising:
an x-ray tube frame;
an anode assembly disposed within the x-ray tube frame;
a cathode assembly disposed within the x-ray tube frame that emits an electron beam to strike a target surface of the anode assembly and form x-rays; and
a plasma-sprayed tungsten oxide coating formed on an inner surface of the x-ray tube frame and on the anode assembly to dissipate heat created by the electron beam;
wherein the plasma-sprayed tungsten oxide coating covers an entirety of the target surface of the anode assembly so as to enhance heat transfer from the anode assembly to the x-ray tube frame.

2. The x-ray tube of claim 1 wherein the plasma-sprayed tungsten oxide coating has an emissivity of greater than 0.9 in the wavelength range of 0.3 to 1.5 micrometers.

3. The x-ray tube of claim 1 wherein the plasma-sprayed tungsten oxide coating has a thickness of approximately 100 micrometers.

4. The x-ray tube of claim 1 wherein the plasma-sprayed tungsten oxide coating, in combination with the x-ray tube frame, is substantially non-transmissive to x-ray radiation.

5. The x-ray tube of claim 1 wherein the anode assembly further comprises:
a focal track on the target surface;
a rotatable shaft connected to the target surface by way of a braze joint; and
a front bearing positioned about the rotatable shaft to allow for rotation therein, wherein the front bearing is connected to the x-ray tube frame by a bolted joint.

6. The x-ray tube of claim 5 wherein the plasma-sprayed tungsten oxide coating is configured to lower a maximum operating temperature of at least one of the focal track, the braze joint, the bolted joint, and the front bearing.

7. The x-ray tube of claim 1 wherein the plasma-sprayed tungsten oxide coating is configured to increase radiative heat transfer from the anode assembly to the x-ray tube frame and from the x-ray tube frame out to an ambient environment.

8. The x-ray tube of claim 1 wherein at least one of the x-ray tube frame and the anode assembly further comprises, at least in part, a tungsten-rhenium alloy.

9. A method of manufacturing an x-ray tube assembly comprising the steps of:
forming a vacuum enclosure, the vacuum enclosure having a high vacuum in an interior volume thereof;
positioning a cathode assembly within the interior volume of the vacuum enclosure;
positioning a target assembly within the interior volume of the vacuum enclosure; and
plasma spraying a tungsten oxide coating to an interior face of the vacuum enclosure and to the target assembly;
wherein the step of positioning the target assembly further comprises:
securing a bearing assembly to the vacuum enclosure;
mounting a rotatable shaft within the bearing assembly;
brazing a target surface to the rotatable shaft by way of a braze joint; and
forming a focal track on the target surface;
wherein plasma spraying the tungsten oxide coating to the target assembly comprises plasma spraying the tungsten oxide coating over the focal track, the target surface and a portion of the rotatable shaft.

10. The method of claim 9 wherein the tungsten oxide coating forms a surface on the interior face of the vacuum enclosure and on the target assembly having an emissivity of above 0.9.

11. The method of claim 9 wherein the step of spraying comprises plasma spraying a tungsten oxide coating onto the interior face of the vacuum enclosure and on the target assembly having a thickness of approximately 100 micrometers.

12. The method of claim 9 wherein the step of positioning the target assembly further comprises:
securing a bearing assembly to the vacuum enclosure;
mounting a rotatable shaft within the bearing assembly;
brazing a target surface to the rotatable shaft by way of a braze joint; and forming a focal track on the target surface.

13. The method of claim 9 further comprising the step of forming the target assembly from a tungsten-rhenium alloy.

14. An x-ray source comprising:

a housing comprising an interior surface that surrounds a vacuum chamber;

an anode assembly positioned within the housing and comprising a shaft, a target cap attached to the shaft, and a focal track formed on the target cap, with the anode assembly connected to the housing by way of a bearing assembly;

a cathode positioned across from the anode assembly within the vacuum chamber and configured to shoot a stream of electrons toward the focal track, wherein thermal radiation having a wavelength range of approximately 0.3 to 1.5 micrometers is formed when the electron stream strikes the focal track; and a plasma-sprayed tungsten oxide coating applied to the interior surface of the housing and to the anode assembly, the plasma-sprayed tungsten oxide coating having a spectral emittance of above 0.9 for the thermal radiation;

wherein the plasma-sprayed tungsten oxide coating covers an entirety of the target cap, including the focal track, and a portion of the shaft.

15. The x-ray source of claim 14 wherein the plasma-sprayed tungsten oxide coating has a thickness of approximately 100 micrometers.

16. The x-ray source of claim 14 wherein the plasma-sprayed tungsten oxide coating is configured to increase radiative heat transfer from the anode assembly to the housing.

17. The x-ray source of claim 14 wherein the anode assembly further comprises a substrate formed of a tungsten-rhenium alloy.

18. The x-ray source of claim 14 wherein the plasma-sprayed tungsten oxide coating has a spectral emittance of approximately 1.0 for the thermal radiation.

19. The x-ray tube of claim 5 wherein the plasma-sprayed tungsten oxide coating covers an entirety of the target surface, including the focal track, and a portion of the rotatable shaft.

* * * * *